US007293553B2

(12) United States Patent
Lindenthal et al.

(10) Patent No.: US 7,293,553 B2
(45) Date of Patent: Nov. 13, 2007

(54) IGNITION COIL FOR AN INTERNAL COMBUSTION ENGINE

(75) Inventors: Konstantin Lindenthal, Blaichach (DE); Nikolaus Hautmann, Ditzingen (DE); Markus Knepper, Waltenhofen/Oberdorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/644,672

(22) Filed: Dec. 22, 2006

(65) Prior Publication Data

US 2007/0175460 A1 Aug. 2, 2007

(30) Foreign Application Priority Data

Dec. 23, 2005 (DE) ..... 10 2005 062 126

(51) Int. Cl.
*H01F 38/12* (2006.01)

(52) U.S. Cl. ..... 123/634

(58) Field of Classification Search ..... 123/634, 123/635

See application file for complete search history.

(56) References Cited

U.S. PATENT DOCUMENTS

2002/0046746 A1* 4/2002 Nakabayashi et al. ..... 123/634
2004/0069288 A1* 4/2004 Shimada et al. ..... 123/635
2004/0231652 A1* 11/2004 Kondo et al. ..... 123/634

FOREIGN PATENT DOCUMENTS

EP 0 859 383 8/1998

* cited by examiner

*Primary Examiner*—Erick Solis
(74) *Attorney, Agent, or Firm*—Kenyon & Kenyon LLP

(57) ABSTRACT

An ignition coil for an internal combustion engine has a rod-shaped magnetic core, which is situated within a secondary coil shell. The annular interspace between the magnetic core and the secondary coil shell is filled with an electrically insulating molded material. To prevent the formation of tears in the molded material during thermomechanical loading, or the spread of such tears such that the operativeness of the ignition coil is adversely affected, a separation element is provided, which divides the molded material into at least two mutually separate regions.

8 Claims, 2 Drawing Sheets

IGNITION COIL FOR AN INTERNAL COMBUSTION ENGINE

BACKGROUND INFORMATION

An ignition coil is described in European Patent No. 0 859 383. In the known ignition coil, the magnetic core is surrounded by a tightly abutting wire or a web (FIGS. 32, 33). The wire or web serves as a separation element between the magnetic core and the coil shell. The remaining annular space relative to the inner wall of the coil shell surrounding the magnetic core is filled with an insulating filler material, in particular an epoxy resin. In the cured state, this epoxy resin constitutes a coherent, sleeve-shaped mass. This is critical inasmuch as, given a tear in the epoxy resin due to thermo-mechanical loading, the tear may widen relatively easily and thereby impair the operability of the ignition coil. Furthermore, concentric positioning of the magnetic core relative to the surrounding coil shell is required. In the known ignition coil, this is done via constructive measures at the end faces of the magnetic core, which require additional work or installation space.

Furthermore, it is also described in European Patent No. 0 859 383 to envelop the magnetic core with the aid of a shrink tube and to insert it into the coil shell. In this case additional constructive measures such as a cover element prevent the presence of epoxy resin between the magnetic core and the coil shell surrounding the magnetic core. This measure also requires additional installation space or additional work.

SUMMARY OF THE INVENTION

The ignition coil according to the present invention for an internal combustion engine has the advantage that the separation element separates the encapsulating compound present in the annular interspace between the magnetic core or the separation element, and the inner wall of the coil shell is subdivided into at least two mutually separate regions in the axial direction. Thus, there is no longer a coherent ring of molded material, with the result that either the thermo-mechanical stresses in the molded material or the encapsulating compound are able to be reduced and tears in the molded material avoided in this manner, or else that their spread is prevented in the event that tears occur.

DETAILED DESCRIPTION

Figure 1:
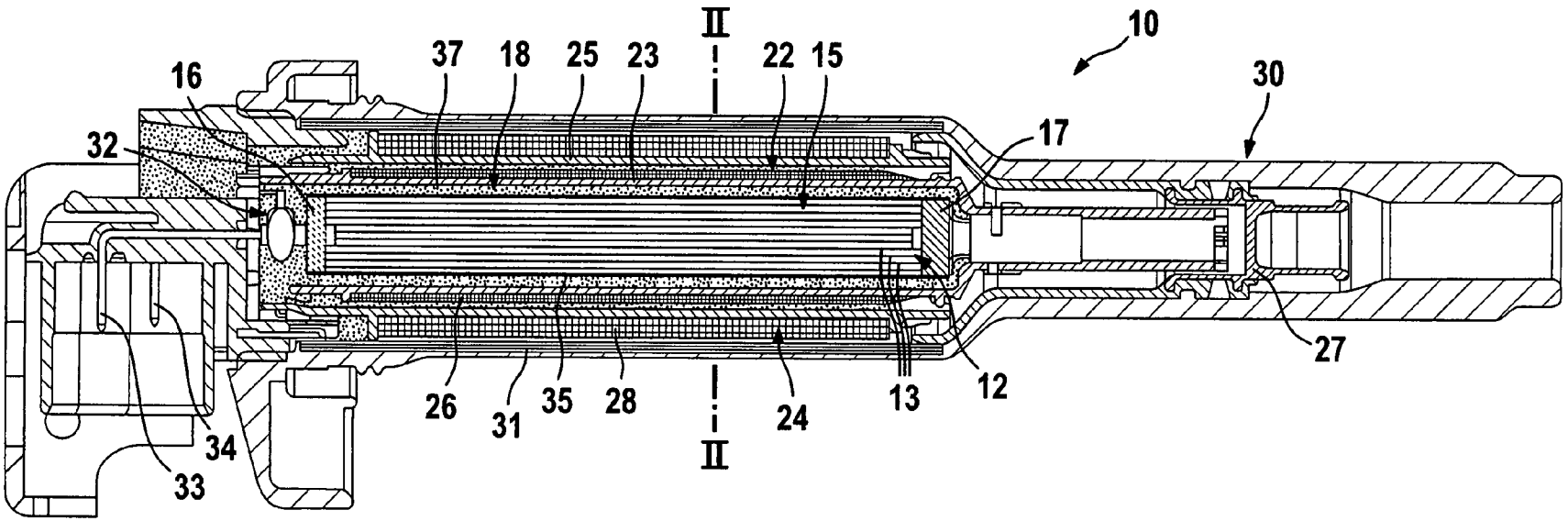
FIG. 1 shows a longitudinal section through an ignition coil according to the present invention.

Ignition coil 10 shown in FIG. 1 is designed as a so-called rod-type ignition coil and is used for the direct contacting of a spark plug (not shown further) of an internal combustion engine. Ignition coil 10 has a magnetically acting, rod-shaped core 12, which is made up of a multitude of sheet metal strips 13, which are rectangular but have different widths and are made of ferromagnetic material so as to achieve an essentially circular cross-sectional area of core 12. Core 12 is part of a so-called core assembly 15, which also includes at least one damping element 16 situated at an end face of core 12, as well as a permanent magnet 17 disposed at the other end face of core 12, or else a so-called core cover disk.

Core 12, together with damping element 16 and permanent magnet 17, is tightly enclosed by a sleeve-shaped element 18. The configuration and the function of element 18 will be discussed in greater detail later on.

Disposed concentrically about core assembly 15 are a secondary coil 22 having a secondary coil shell 23, and a primary coil 24 having a primary coil shell 25. High voltage carrying secondary winding 26 of secondary coil 22 is coupled to a sleeve-shaped contacting element 27, which accommodates the head of the spark plug. Contacting element 27 and primary coil 24 are situated inside an ignition coil housing 30, which defines the outer form of ignition coil 10. In addition, a longitudinally slotted, sleeve-shaped magnetic yoke sheet 31 for the magnetic circuit of ignition coil 10 is disposed inside ignition coil housing 30.

An electric circuit 32 coupled to primary winding 28 is disposed inside ignition-coil housing 30 on the side of primary coil 24 situated opposite from contacting element 27. Electric circuit 32 is coupled to the on-board voltage of the motor vehicle via connector plugs 33, 34. An ignition coil 10 described so far as well as its method of functioning are already known in general and will therefore not be elucidated further.

When ignition coil 10 is assembled, the mentioned components of ignition coil 10 are inserted into ignition coil housing 30, whereupon ignition coil housing 30 is filled from the side of connector plugs 33, 34 with an initially liquid epoxy resin, which is used as molded material 35 and fills up the interspaces between the individual components of ignition coil 10 and thereby provides insulation between the voltage-carrying components. In order to facilitate the encapsulating process and to promote the discharge of air sealed in ignition coil housing 30, the encapsulation is carried out in a vacuum.

Molded material 35 also penetrates the annular space between core 12 and inner wall 36 of secondary coil shell 23. To prevent or reduce the formation of tears in molded material 35 during thermo-mechanical loading, element 18 is provided, which subdivides molded material 35 into a plurality of regions 37 separated by element 18, regions 37 extending parallel to the longitudinal axis of core 12 across its entire longitudinal extension. Element 18 prevents, in particular, the formation of individual coherent annular regions of molded material 35, which bridge the space between core 12 and secondary coil shell 23 in the event of an occurring tear.

Figure 2:
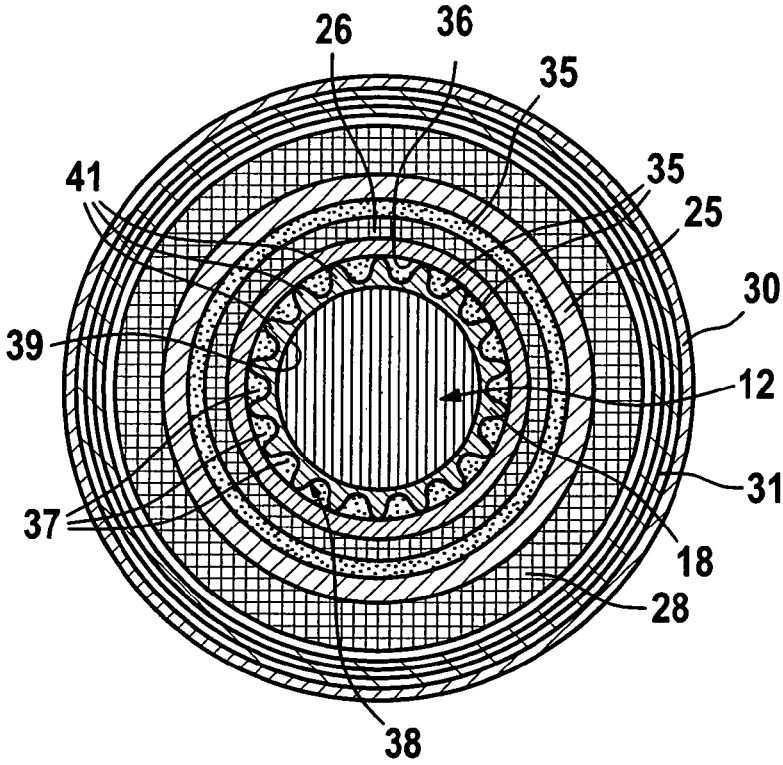
FIGS. 2 and 3 show an individual section along plane II-II of FIG. 1 in different specific embodiments.

In the first exemplary embodiment shown in FIG. 2, element 18 is made up of a shrink tube 38, which has a smooth surface on its inner circumference 39, while longitudinal ribs 41 are formed on its outside between which molded material 35 is present. At least one of longitudinal ribs 41 is in contact with inner wall 36 of secondary coil shell 23 after assembly. Following installation of shrink tube 38 and its heating, inner circumference 39 of shrink tube 38 tightly abuts core 12. Longitudinal ribs 41 preferably have an identical design and are positioned with uniform angular spacing with respect to each other, so that all longitudinal ribs 41 rest against inner wall 36 of secondary coil shell 23. This causes centering of core 12 in secondary coil shell 23 relative to secondary coil shell 22 by means of longitudinal ribs 41, so that additional centering measures may possibly be dispensed with.

Figure 3:
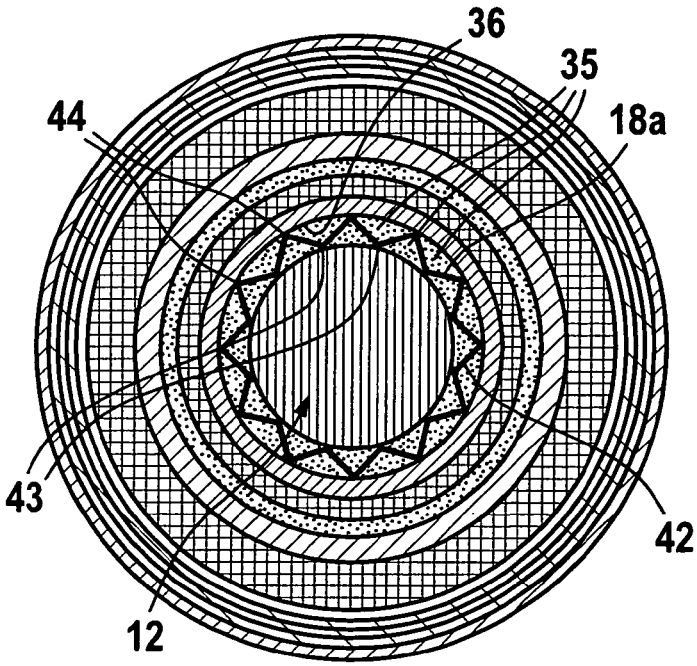

In the second exemplary embodiment shown in FIG. 3, element 18*a* is realized in the form of a wavy or pleated foil 42. Foil 42 may be made of plastic or else include one layer or a plurality of layers having different material properties, in particular. Different material properties are understood to denote, for instance, different hardnesses or different adhesion characteristics with respect to molded material 35. Foil 42 is preferably closed onto itself so as to form a hose-shaped tube, which rests against core 12 or secondary coil shell 23 via its longitudinal edges 43, 44 once it is slipped over core 12 and installed in secondary coil shell 23. Foil 42 therefore also prevents coherent rings of encapsulating compound, molded material 35 being present both between core 12 and foil 42, and also between foil 42 and secondary coil shell 23. Due to the fact that at least a plurality of longitudinal edges 43, 44 rests against core 12 and inner wall 36 of secondary coil shell 23 in the second exemplary embodiment as well, centering of core 12 with respect to secondary coil 22 takes place.

In addition, it should be pointed out that ignition coil 10 is able to be modified in a variety of ways without deviating from the inventive thought. For instance, it is conceivable to switch the placement of secondary coil 22 and primary coil 24, so that primary coil 24 is situated on the inside.

What is claimed is:

1. An ignition coil for an internal combustion engine, comprising:

a rod-shaped magnetic core;

a coil having a coil shell and concentrically surrounding the magnetic core;

an ignition coil housing in which the magnetic core and at least the coil are situated;

a separation element surrounding the magnetic core in a longitudinal direction; and molded material situated between the separation element and the coil shell, wherein the separation element subdivides the molded material into at least two mutually separate regions.

2. The ignition coil according to claim 1, wherein the separation element has at least one section that is in contact with an inner wall of the coil shell.

3. The ignition coil according to claim 2, wherein the separation element has a plurality of sections in contact with one of the inner wall of the coil shell and the magnetic core, the sections effecting centering of the magnetic core with respect to the coil shell.

4. The ignition coil according to claim 2, wherein the separation element is made of an elastic material, including a shrink tube.

5. The ignition coil according to claim 4, wherein at least one rib is integrally formed on the separation element and forms the at least one section.

6. The ignition coil according to claim 1, wherein the separation element is formed one of (a) from a flat material by introducing a wave form, and (b) by longitudinal edges.

7. The ignition coil according to claim 6, wherein the separation element has a form that is closed onto itself and is elastically deformable at its circumference.

8. The ignition coil according to claim 6, wherein the separation element is made up of a plurality of layers which one of (a) are made of different materials and (b) have different material properties.

* * * * *